US009064412B2

(12) United States Patent
Baur

(10) Patent No.: US 9,064,412 B2
(45) Date of Patent: Jun. 23, 2015

(54) METHOD FOR PROVIDING INFORMATION TO FIRST RESPONDERS OF VEHICLE ACCIDENTS

(71) Applicant: Bayerische Motoren Werke Aktiengesellschaft, Munich (DE)

(72) Inventor: Peter Baur, Ramsey (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 70 days.

(21) Appl. No.: 14/049,438

(22) Filed: Oct. 9, 2013

(65) Prior Publication Data

US 2015/0097703 A1 Apr. 9, 2015

(51) Int. Cl.

| | |
|---|---|
| ***G08G 1/00*** | (2006.01) |
| ***G08G 1/0967*** | (2006.01) |
| ***G08G 1/0962*** | (2006.01) |

(52) U.S. Cl.

CPC ..... *G08G 1/096791* (2013.01); *G08G 1/207* (2013.01); *G08G 1/09626* (2013.01)

(58) Field of Classification Search

CPC ..... G08G 1/207; G08G 1/09626
USPC ..... 340/902, 905, 907, 991, 993, 995.13; 345/633

See application file for complete search history.

(56) References Cited

U.S. PATENT DOCUMENTS

| | | | | |
|---|---|---|---|---|
| 6,690,302 | B1 * | 2/2004 | Inomata | 340/989 |
| 8,289,187 | B1 * | 10/2012 | Kerr | 340/905 |
| 2013/0006469 | A1 * | 1/2013 | Green et al. | 701/36 |

* cited by examiner

*Primary Examiner* — Tai T Nguyen
(74) *Attorney, Agent, or Firm* — Crowell & Moring LLP

(57) ABSTRACT

Vehicle-specific and/or accident-specific information is provided, by a backend server, to the user of the first responder application executing on a mobile device. The application is configured to provide the mobile device's current location to the backend server, so that nearby vehicles involved in accidents may be identified to the user of the application. The application may further be configured to receive a user selection of a particular accident from the list of accidents provided by the backend server and, in response thereto, provide vehicle-specific and/or accident-specific information for display on the mobile device.

18 Claims, 5 Drawing Sheets

METHOD FOR PROVIDING INFORMATION TO FIRST RESPONDERS OF VEHICLE ACCIDENTS

FIELD OF THE INVENTION

The present invention relates generally to providing information to the first responders of vehicle accidents, and more particularly to providing accident-specific and vehicle-specific information to vehicle accident first responders before or upon arriving at an accident's location.

BACKGROUND OF THE INVENTION

While many vehicles are now equipped with Automatic Crash Notification (ACN) systems, first responders currently have no way to access vehicle-specific or accident-specific information before or even upon arriving at the accident location. Currently, upon arriving at an accident scene, first responders must first assess the severity of the accident, as well as the number of occupants and extent of injury to those occupants. This delay impedes the first responders from being able to provide immediate assistance, which may have life threatening consequences. Moreover, depending on the severity of the accident, first responders must further consider the type of vehicle(s) involved in the accident since different vehicles tend to have different properties that can affect how the first responders should provide rescue help, such as the optimum location to cut a vehicle in order to quickly and safely extract the vehicles' occupants, for example. Such vehicle-specific information may also improve the safety of the first responders themselves in allowing them to specifically prepare for the risks associated with a particular vehicle type, e.g., potential high voltage danger associated with electric vehicles.

While there have been some efforts to extend the functionality of ACN systems to include the transmission of information to the appropriate public service answering point, for example, there remains a need for providing first responders with vehicle- and/or accident-specific information before or upon arriving at an accident's location in order to enable the first responders to more quickly and effectively provide rescue assistance.

SUMMARY OF THE INVENTION

Disclosed and claimed herein are methods and devices for providing information to first responders of vehicle accidents. In one embodiment, the method includes transmitting, by a mobile device, location information to one or more backend servers over a wireless network connection in response to receiving a location-based accident information request from a user via a user input. The method further includes receiving, by the mobile device from the one or more backend servers over the wireless network connection, a list of accidents identified as being in proximity to the mobile device, and then displaying at least one accident indication for a corresponding at least one accident from the received list of accidents identified as being in proximity to the mobile device. Additionally, the method includes receiving, from the user, a selection of an accident of interest from the displayed at least one accident indication, and then requesting, in response to the selection of the accident of interest, information corresponding to the accident of interest, which may then be displayed in the form of at least one of vehicle-specific and accident-specific information corresponding to the accident of interest.

Other aspects, features, and techniques of the invention will be apparent to one skilled in the relevant art in view of the following description of the exemplary embodiments of the invention.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE EXEMPLARY EMBODIMENTS

Figure 1A:
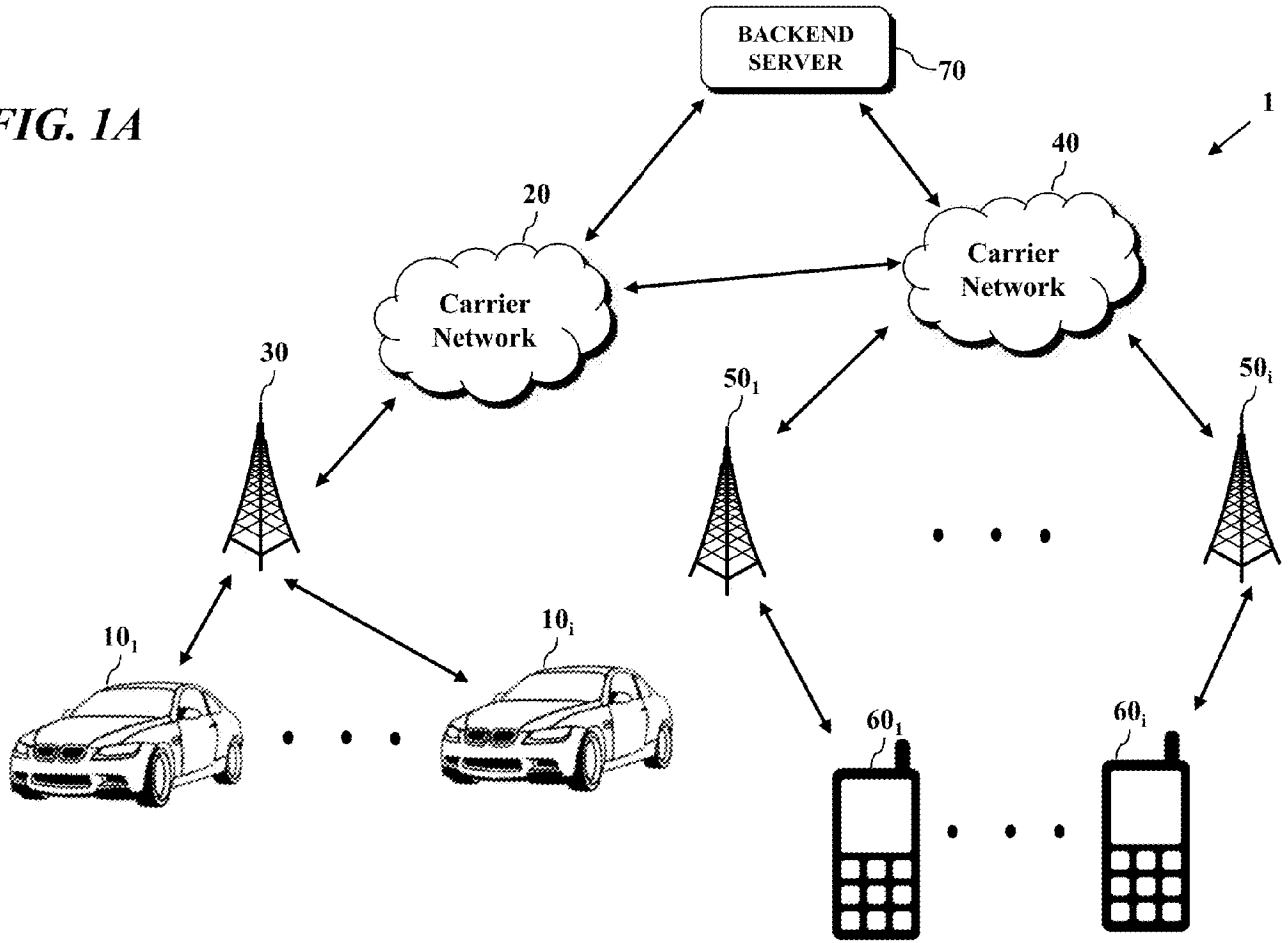
FIG. 1A is a block diagram illustrating an exemplary communication system in which one or more aspects of the invention may be implemented.

One aspect of the present disclosure is to provide a first responder application that is executable on a mobile device. After, or in connection with the first responder application being launched on the device, a user may provide an accident search request using, for example, the device's touchscreen or other user input. In certain embodiments, the accident search request may be a location-based search, in which case the mobile device's current location may be transmitted to a backend server, which is preferably configured to implement an ACN system. The backend server may be configured to compare the location information received from the first responder application to location information received from any number of ACN-equipped vehicles that are within proximity to the particular mobile device. Based on the comparison operation carried out by the backend server, a list of nearby vehicles involved in accidents may then be provided to the user of the first responder application.

Another aspect of the disclosure is to enable a user selection of a particular accident from the list of accidents provided by the backend server. Then, in response to the user selection of a particular accident, vehicle-specific and/or accident-specific information may be provided, by the backend server, to the user of the first responder application, thereby enabling a first responder to better provide accident rescue and treatment services.

Still another aspect of the disclosure is to provide vehicle-specific information in response to identifying a particular vehicle type based on one or more vehicle-related parameters that are provided by the user of the mobile device. Such vehicle-related parameters may correspond to a vehicle known to be in an accident and may comprise vehicle picture information, VIN information, etc. In certain embodiments, such vehicle-specific information may include available rescue information particular to the vehicle type, such as information from a vehicle's rescue manual.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment", "certain embodiments", "an embodiment" or similar term means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner on one or more embodiments without limitation.

In accordance with the practices of persons skilled in the art of computer programming, the invention is described below with reference to operations that are performed by a computer system or a like electronic system. Such operations are sometimes referred to as being computer-executed. It will be appreciated that operations that are symbolically represented include the manipulation by a processor, such as a central processing unit, of electrical signals representing data bits and the maintenance of data bits at memory locations, such as in system memory, as well as other processing of signals. The memory locations where data bits are maintained are physical locations that have particular electrical, magnetic, optical, or organic properties corresponding to the data bits.

When implemented in software, the elements of the invention are essentially the code segments to perform the necessary tasks. The code segments can be stored in a processor readable medium or transmitted by a computer data signal. The "processor readable medium" may include any medium that can store information. Examples of the processor readable medium include an electronic circuit, a semiconductor memory device, a ROM, a flash memory or other non-volatile memory, a floppy diskette, a CD-ROM, an optical disk, a hard disk, etc.

The term "backend server" means a functionally-related group of electrical components, such as a computer system in a networked environment which may include both hardware and software components, or alternatively only the software components that, when executed, carry out certain functions. The "backend server" may be further integrated with a database management system and one or more associated databases.

FIG. 1A illustrates a block diagram of a communication system 1 configured to implement one or more aspects of the invention. In one embodiment, the communication system 1 provides a wireless communication channel for cellular-capable vehicles, such as vehicles $\mathbf{10}_1$-$\mathbf{10}_i$ ("10"), which communicate with a carrier network 20 via a local base station 30. Carrier network 20 may be configured to provide a myriad of network layer services, including but not limited to location-based service, messaging service, conferencing service, presence service, etc., and vehicles 10 may be capable of engaging in dispatch calling, interconnect calling, roaming, message mail and/or data communications over the communications system 1.

Continuing to refer to FIG. 1A, the communication system 1 will preferably service additional mobile devices $\mathbf{60}_1$-$\mathbf{60}_i$ ("60"). In certain embodiments, mobile devices 60, which will be described in more detail below with respect to FIG. 1B, may be connected to a different carrier network 40 and serviced by separate base stations $\mathbf{50}_1$-$\mathbf{50}_i$ ("50"). Moreover, as the vehicles 10 or mobile devices 60 move from having network coverage from carrier network 20 to a different carrier network (e.g., carrier network 40), the available network layer services may similarly change. In addition, it should be appreciated that carrier networks 20 and 40 may be GSM, CDMA, etc., and may be accessible using a variety of access technologies.

The communication system 1 further comprises a backend server 70 that may be operated by or on behalf of a manufacturer(s) of vehicles 10. It should be appreciated that the backend server 70 may be implemented using a plurality of geographically dispersed servers, or may be implemented in a more centralized architecture.

The vehicles 10 may preferably be equipped with an ACN system which communicates with backend server 70 to provide vehicle- and/or crash-related information, as is generally known in the art. As is known, ACN systems are generally capable of detecting when a vehicle has been in an accident of a certain severity, and then to automatically transmit the vehicle's location, vehicle-related information and crash information to a backend server, such as backend server 70. Such information may be communicated to the backend server 70 as a Vehicular Emergency Data Set, which is an XML-based standard for reporting collision data elements and medical data elements related to a collision. The ACN system may be further configured to enable voice communication between an operator of the vehicle and a response specialist. In addition, the vehicles 10 may be equipped to provide numerous features and may also include various applications, such as browser applications, chat clients, email clients, Java, personal information management applications, etc.

Figure 1B:
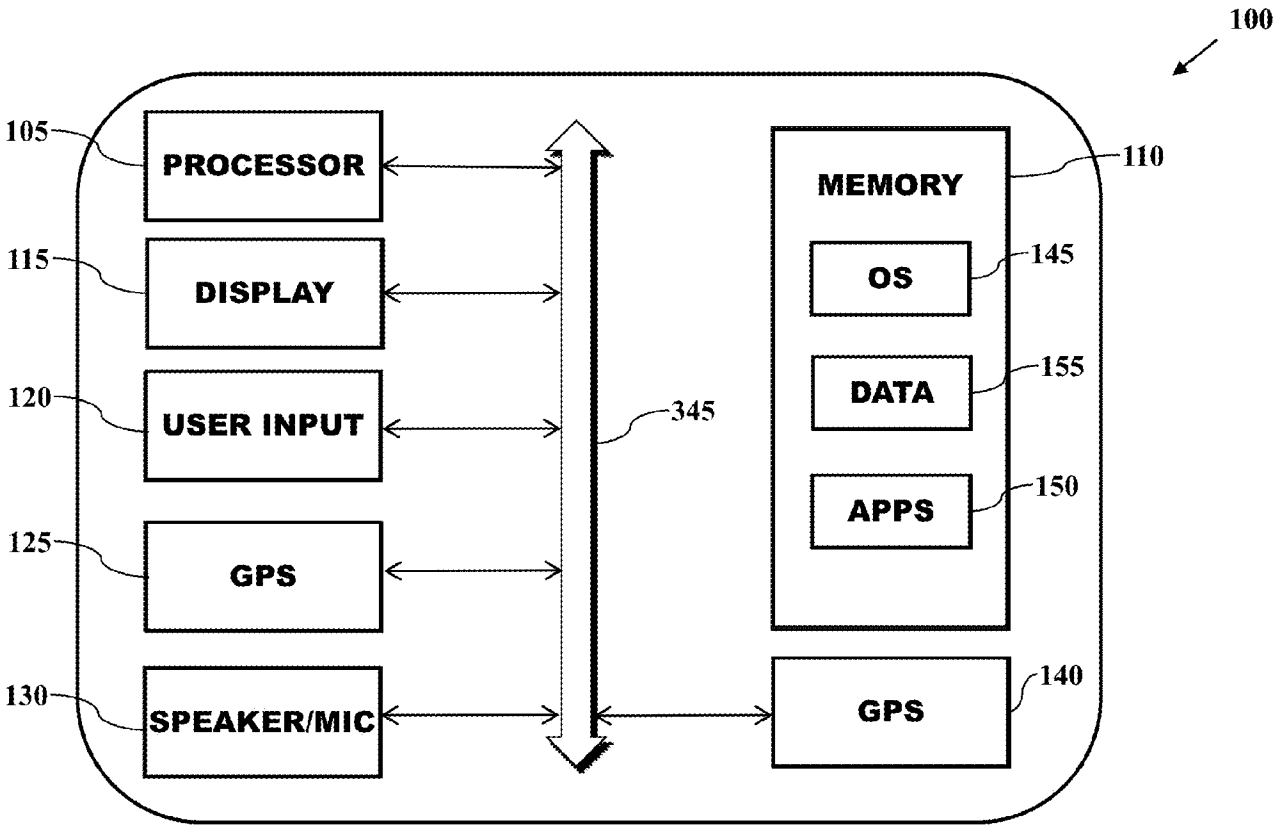
FIG. 1B illustrate a simplified schematic of a device configured to implement one or more aspects of the invention within the communication environment of FIG. 1A.

With reference now to FIG. 1B, depicted is one embodiment of a mobile device 100, which corresponds to the mobile device 60 of FIG. 1A, and which is capable of implementing one or more aspects of the invention. The mobile device 100, which may be a cellular telephone, smartphone, PDA, digital camera, handheld computer, etc., includes a processor 105, a memory 110, a touchscreen display 115 and a user input 120, each being interconnected by bus 135. The mobile device 100 may also include GPS transceiver and related circuitry 125 and speaker/microphone 130. Finally, the mobile device 100 comprises a radio frequency interface 140 that performs the function of transmitting and receiving radio frequency signals from one or more wireless networks, such as carrier networks 20 and/or 40 described above with reference to FIG. 1A. It should be appreciated that the processor 105 may be a general processor, a digital signal processor, an application-specific integrated circuit, digital logic device, an analog processor or other now known processing circuit.

With respect to the user input 120, it may be implemented using a keypad, such as a push-button dialing pad, a keyboard or the like. The touchscreen display 115 may be an LCD or any other type of display commonly used in consumer electronic devices. Since the display 115 is preferably touch-sensitive, it may serve the dual function of being a display screen as well as part of the user input 120.

Memory 110 may include random access memory and/or non-volatile memory, such as flash memory or the like. As shown, stored in memory 110 is at least one operating system 145, which comprises procedures (or sets of instructions) for handling basic system services and for performing hardware dependent tasks. One or more applications 150 and data 155 may also be stored in memory. One of the applications 150 that is preferably stored in memory 110 and executable on the mobile device 110 by processor 105 is a first responder application, which is described in detail below. Although not necessarily pertinent to the scope of the disclosure, it should be appreciated that the applications 150 may also comprise one or more of a web browser, chat interface application, a camera application, a phone dialer program, email client, word processing application, etc.

Figure 2:
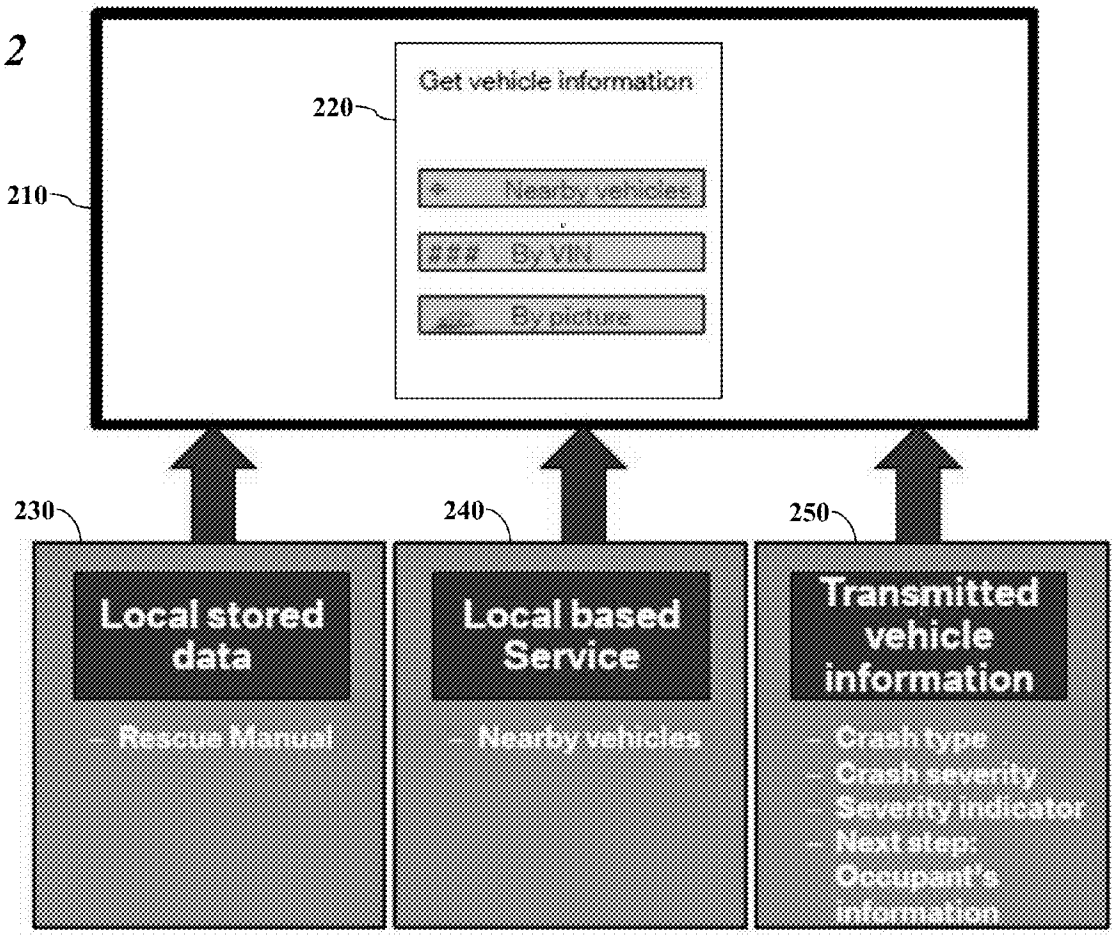
FIG. 2 illustrates certain aspects of one embodiment of a first responder application, configured in accordance with the principles of the invention.

Referring now to FIG. 2, depicted is a simplified block diagram of a mobile device 210, having a configuration consistent with the mobile device 100 of FIG. 1B such that it is able to engage in wireless communications using the communication system 1 of FIG. 1A. In the embodiment of FIG. 2, the mobile device 210 has launched a first responder application, and is displaying on display 220 various user-selectable options. In particular, the first responder application is displaying different options the user has for obtaining vehicle- and/or accident-specific information about one or more vehicles. As will be described in more detail below with reference to FIGS. 3 & 4, the first responder application may be used by a first responder to obtain vehicle- and/or accident-specific information about a vehicle that has been involved in an accident before or upon the first responder arriving at the scene of the accident.

The first responder application of FIG. 2 is particularly configured to access and display locally stored data, such as a vehicle-specific rescue manual, in response to the identification and user selection of a particular vehicle. Such manuals are generally published by vehicle manufacturers and contain vehicle-specific information regarding vehicle type, vehicle engine type, fuel level, airbag configuration, location of batteries, high voltage wires, location of bodywork reinforcements, recommended cut locations for roof removal, location of door hinges and door locks, special instructions (i.e. for hybrid and electric vehicles), etc.

In addition, the first responder application of FIG. 2 is further configured to provide location based services regarding, for example, other vehicles that may be nearby a known accident scene. Finally, the first responder application is configured to receive, process and display vehicle- and/or accident-specific information corresponding to the selected vehicle, including for example, likelihood of severe injury, a crash type, area of impact, angle of impact, number of occupants, seat position of occupants, etc.

Figure 3:
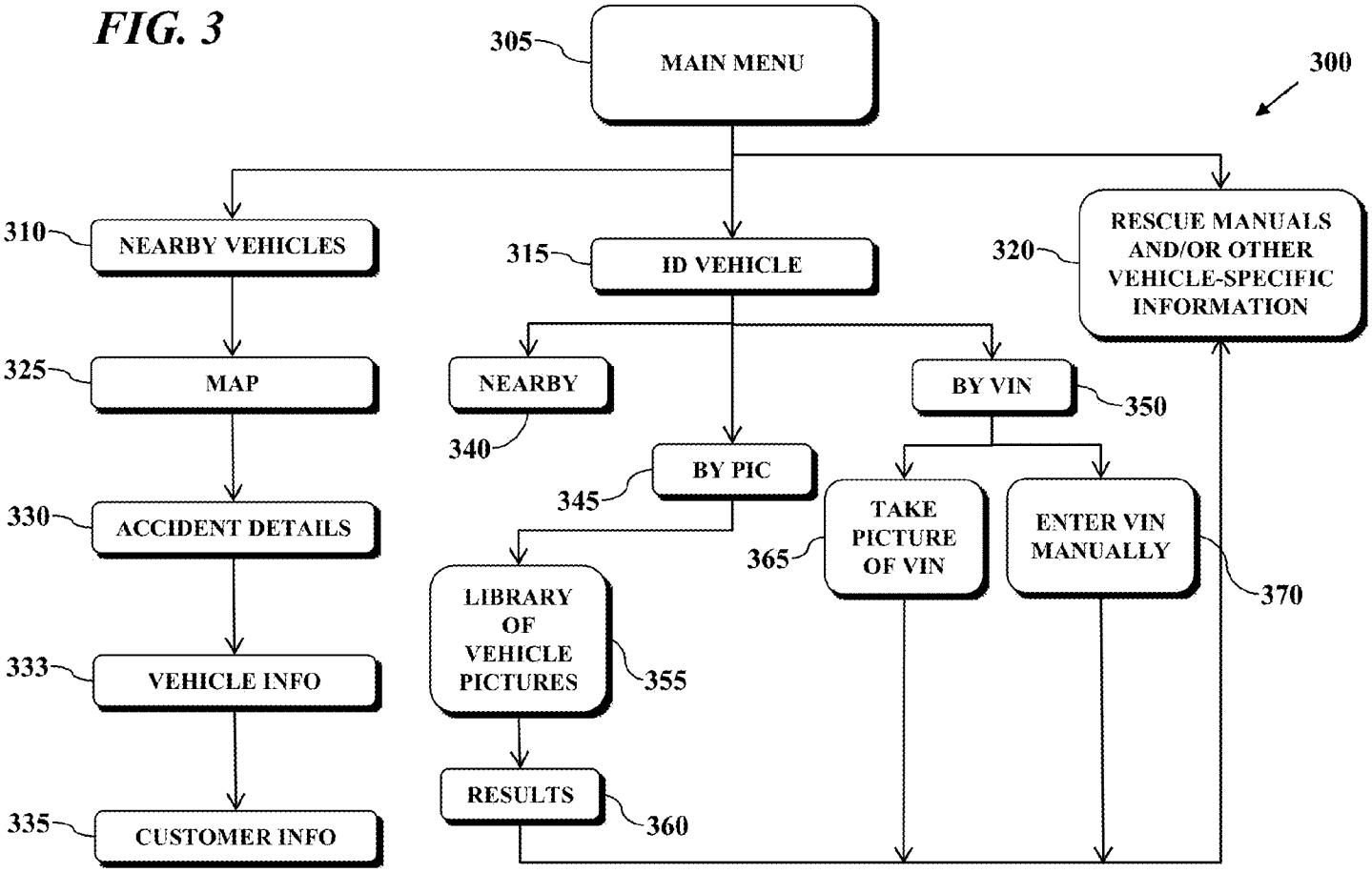
FIG. 3 is a flow diagram of various operations carried out by one embodiment of a first responder application, configured in accordance with the principles of the invention.

Referring now to FIG. 3, depicted is a flow diagram of a process 300 for utilizing the first responder application of FIG. 2. The process 300 begins with a mobile device, such as mobile device 60, 100 or 210, displaying a main menu 305 on a display screen, such as display 115 or 220, after the first responder application has been launched. In this embodiment, the main menu 300 comprises three user-selectable options, including 'nearby vehicles' 310, 'ID vehicle' 315 and 'rescue manual/vehicle information' 320. It should of course be appreciated that more or fewer options may be displayed as part of the main menu 305. Moreover, it should be appreciated that if a first responder has not yet arrived at the location of an accident, it is more likely that the first responder would be interested in 'nearby vehicles' 310. Conversely, if the first responder has already arrived at the location of an accident, then the responder may be more interested in the 'ID vehicle' 315 and 'rescue manual/vehicle information' 320 options since location and accident-specific information should be readily available to such an already-on-site responder, while vehicle type and vehicle-specific information may tend to be more useful at that point.

In response to a first responder selection of the nearby vehicles option 310, the first responder application may transmit the mobile device's current location to a backend server, such as backend server 70 described above with reference to FIG. 1. The backend server 70, which is preferably configured to implement an ACN system, may then compare the location information received from the first responder application to location information received from any ACN-equipped vehicles (e.g., vehicles 10) that are within some defined proximity to the particular mobile device. It should be appreciated that this comparison operation may be based on a proximity that is user-defined (e.g., within a predetermined radius).

The above comparison operation that is carried out by the backend server may then return a list of nearby vehicles 310. Additionally, the first responder application may display a map 325 on which the nearby vehicles 310 are graphically represented to the user. Either automatically or upon receiving a user request, the backend server may additionally provide accident details 330, vehicle details 333 and/or customer information 335. In certain embodiment, the accident details 330 may include a likelihood of severe injury, a crash type, area of impact, angle of impact, number of occupants, seat position of occupants, etc. Vehicle details 333 may include vehicle type, vehicle engine type, fuel level, airbag configuration, location of batteries, high voltage wires, location of bodywork reinforcements, recommended cut locations for roof removal, location of door hinges and door locks, special instructions (i.e. for hybrid and electric vehicles), etc. And customer information 335 may include age, prescriptions, existence of medical condition, medication allergies, emergency contact information, etc. Armed with this information, a first responder, who is either still on the way to the scene of an accident or has just arrived at one, will be able to immediately decide how best to provide accident rescue and treatment services.

Continuing to refer to FIG. 3, in response to a first responder selection of the ID vehicle option 315 from the main menu 305, the first responder application may present the user with additional options for particularly identifying a vehicle of interest. In particular, those options may include a 'Nearby' option 340, a 'By Pic' option 345 and a 'By Vin' option 350. Selecting the 'Nearby' option 340 will, as noted above, return a list of nearby vehicles.

A user selection of the 'By Pic' option 345, on the other hand, might provide the first responder with the ability to take a picture of a vehicle that has been involved in an accident, and compare that picture to a library of vehicle pictures 355, so as to identify the specific type of vehicle that was involved in the accident. This option may only be available when the mobile device, on which the first responder application is running, is equipped with a camera. Since image comparison, particular when it involves a vehicle that has been involved in an accident, may not provide perfect results in all cases, a list of potential matches 360 may be displayed to the first responder for selection therefrom.

Alternatively, the 'By Pic' option 345 may present the first responder with a series of vehicle pictures (e.g., from the library of vehicle pictures 355) representing the various possible vehicle types. From these images, the first responder will be able to visual identify and select a vehicle type matching the particular vehicle involved in the accident. In either event, it should be appreciated that the library of vehicle pictures 355 may be contained in local memory of the mobile device, or may be stored in a memory associated with a backend server (e.g., backend server 70). When the library of vehicle pictures 355 is remotely stored, it may be necessary for the mobile device to transmit the picture that was captured to the backend server for comparison against the remotely-stored library of vehicle pictures 355.

As a result of invoking the 'By Pic' option 345, the appropriate rescue manual/vehicle information 320 may be loaded from memory, either automatically or in response to a further user selection. As noted above, such rescue manuals contain potentially valuable vehicle-specific information that can significantly improve the first responder's ability to provide effective accident rescue and treatment services. It should be appreciated that other types of vehicle-specific information may be provided in addition to or instead of such a rescue manual.

Finally, a user of the first responder application of FIG. 3 may identify the specific type of vehicle 360 that was involved in the accident using the Vehicle Identification Number (VIN). When the mobile device is equipped with a camera, a picture of the VIN 365 may be used, in conjunction with known optical character recognition technology, to identify the vehicle of interest. In certain embodiments, in order to identify the vehicle it may be necessary to transmit the VIN to a backend server (e.g., backend server 70) where a database may be queried using the provided VIN. Alternatively, the VIN may be manually entered (370) into the mobile device by the first responder.

Regardless of how the VIN is used to identify the vehicle type, the first responder application may then automatically, or in response to a further user selection, load the appropriate rescue manual/vehicle information 320 from memory, or from a backend server, thereby providing potentially valuable vehicle-specific information to the first responder upon arriving at the scene of an accident.

Figure 4:
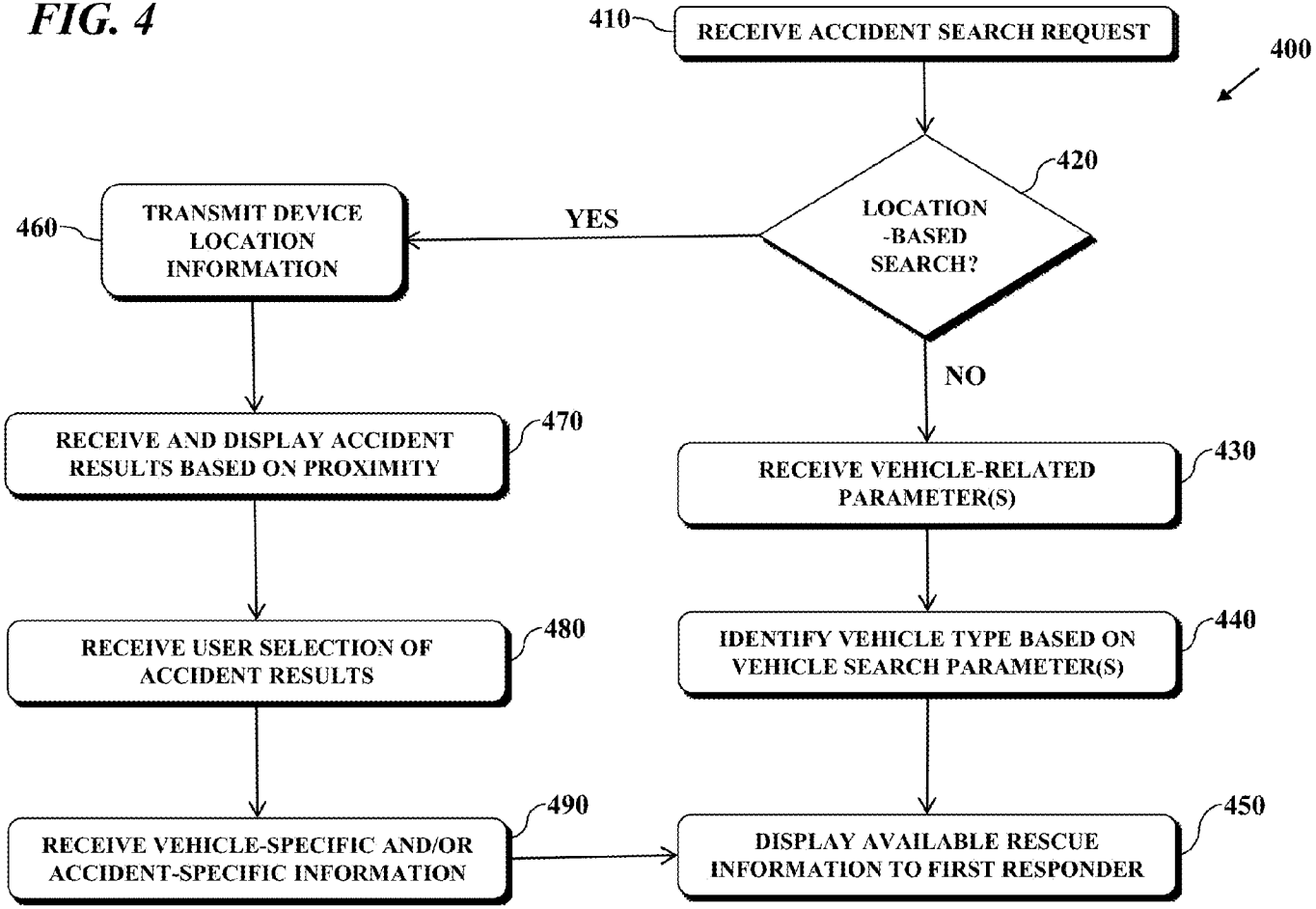
FIG. 4 is another flow diagram of various operations carried out by one embodiment of a first responder application, configured in accordance with the principles of the invention.

Referring now to FIG. 4, depicted is a flow diagram 400 for how one or more aspects of the invention may be carried out using a mobile device, such as mobile device 60, 100 or 210, that is executing the above-described first responder application, in accordance with the principles of the invention. Process 400 begins at block 410 where an accident search request may be received by the first responder application. The search request may be received by the mobile device via a touchscreen or other user input, such as a touchscreen display 115 and/or user input 120 of FIG. 2.

Once the first responder application receives an accident search request, process 400 may continue to block 420 where a determination may be made as to whether the search is to be a location-based search. In other words, is the search request based on a location of an accident or not. For example, if a first responder has not yet arrived at the location of an accident, it is more likely that the search will be a location-based search. Conversely, if the first responder has already arrived at the location of an accident, then the search need not be location-based.

If it is determined at block 420 that the search request is not location-based, process 400 may continue to block 430 where one or more vehicle-related parameters may then be received. Such vehicle-related parameters may correspond to a vehicle known to be in an accident and may comprise vehicle picture information, VIN information, etc.

Once one or more valid vehicle-related parameters have been received by the first responder application from the user, process 400 may continue to block 440 where the vehicle type of interest may be identified using the provided vehicle-related parameters. It should be appreciated that the operation of block 440 may be based on a query of a locally stored database, or it may be based on a query of a remote database, such as a database associated with a backend server (e.g., backend server 70) with which the mobile device is in communication over a wireless communication network, such as the wireless communication system 1 of FIG. 1.

Once the vehicle type has been identified, process 400 may then continue to block 450 where any available rescue information for the vehicle type may be displayed to the user, such as on a display screen (e.g., display 115) of the mobile device. As noted above, in certain embodiments such information may comprise a rescue manual directed to the specifically-identified vehicle, and may contain vehicle-specific information regarding vehicle type, vehicle engine type, fuel level, airbag configuration, location of batteries, high voltage wires, location of bodywork reinforcements, recommended cut locations for roof removal, location of door hinges and door locks, special instructions (i.e. for hybrid and electric vehicles), etc.

Continuing to refer to FIG. 4, if it is determined at block 420 that the accident search is location-based, then process 400 may continue to block 460 where the first responder application may transmit the mobile device's current location to a backend server, such as backend server 70 described above with reference to FIG. 1. The backend server 70, which is preferably configured to implement an ACN system, may then compare the location information received from the first responder application to location information received from any ACN-equipped vehicles (e.g., vehicles 10) that are within proximity to the particular mobile device, as first described above with reference to FIG. 3.

Following the comparison operation carried out by the backend server, the process 400 may then continue to block 470 where a list of nearby vehicles involved in accidents may be received and provided to the user, such as by displaying a list of vehicles known to be involved in accidents within some defined proximity to the mobile device, or by displaying the relative location of such accidents on a displayed map (e.g., map 325 on which the nearby vehicles 310 are graphically represented to the user). Again, this information would be available to the backend server for vehicles equipped with ACN systems.

A user selection of a particular accident from the list of accidents provided at block 470, whether in the form of a list or on a graphical map, may then be received at block 480. It should be appreciated that such user selection may be received by the mobile device via a touchscreen or other user input.

Either automatically following the user selection of block 480, or upon receiving a further user input, process 400 may continue to block 490 where vehicle-specific and/or accident-specific information may be received by the first responder application from the backend server (e.g., backend server 70 of FIG. 1). Such accident-specific information may include, for example, likelihood of severe injury, a crash type, area of impact, angle of impact, number of occupants, seat position of occupants, etc., while such vehicle-specific information may include vehicle type, vehicle engine type, fuel level, airbag configuration, location of batteries, high voltage wires, location of bodywork reinforcements, recommended cut locations for roof removal, location of door hinges and door locks, special instructions (i.e. for hybrid and electric vehicles), etc. It should also be appreciated that certain customer information, such as emergency contact information, may also be received from the backend server at block 490.

Once vehicle-specific and/or accident-specific information has been received at block 490, all or some subset of the received information may then be displayed to the first responder, as was described above with reference to block 450. Armed with this information, a first responder, who is either still on the way to the scene of an accident or has just arrived at one, will be able to immediately decide how best to provide accident rescue and treatment services.

While the invention has been described in connection with various embodiments, it should be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. A method for providing information to first responders of vehicle accidents, the method comprising the acts of:

transmitting, by the mobile device, location information to one or more backend servers over a wireless network connection in response to receiving a location-based accident information request from a user via a user input;

receiving, by the mobile device from the one or more backend servers over the wireless network connection, a list of accidents identified as being in proximity to the mobile device;

displaying at least one accident indication for a corresponding at least one accident from the received list of accidents identified as being in proximity to the mobile device;

receiving, by the mobile device from the user, a selection of an accident of interest from the displayed at least one accident indication;

requesting, by the mobile device and in response to the selection of the accident of interest, information corresponding to the accident of interest; and displaying, by the mobile device, at least one of vehicle-specific and accident-specific information corresponding to the accident of interest.

2. The method of claim 1, wherein transmitting location information comprises transmitting, by the mobile device, a current GPS location of the mobile device.

3. The method of claim 1, wherein receiving the list of accidents comprises receiving, by the mobile device from the one or more backend servers over the wireless network connection, the list of accidents, wherein the list of accidents comprises accidents identified as being within a predetermined area around a current location of the mobile device.

4. The method of claim 1, wherein the list of accidents comprises accidents involving vehicles equipped with an automatic crash notification system that is in communication with the one or more backend servers.

5. The method of claim 1, wherein displaying the at least one accident indication further comprises displaying at least one accident icon on a graphical map on a display of the mobile device.

6. The method of claim 1, wherein the vehicle-specific information comprises at least one of vehicle type, vehicle engine type, fuel level, airbag configuration, location of batteries, high voltage wires, location of bodywork reinforcements, recommended cut locations for roof removal, location of door hinges and door locks and vehicle-special instructions.

7. The method of claim 1, wherein the accident-specific information comprises at least one of a likelihood of severe injury, a crash type, area of impact, angle of impact, number of occupants, and seat position of occupants.

8. The method of claim 1, further comprising:

receiving, by the mobile device, a non-location-based vehicle search request and one or more vehicle search parameters from the user via the user input;

identifying, by the mobile device, a vehicle type based on said one or more vehicle search parameters; and displaying, by the mobile device, vehicle-specific rescue information.

9. The method of claim 8, wherein the one or more vehicle search parameters comprises one of a vehicle identification number and vehicle image data.

10. A mobile device configured to provide information to first responders of vehicle accidents, the mobile device comprising:

a display screen;

a wireless communication interface;

one or more processors electrically coupled to the display screen and the wireless communication interface; and a memory containing one or more programs configured for execution by the one or more processors, wherein the one or more programs include processor-executable instructions for:

transmitting location information to one or more backend servers over a wireless network connection via the wireless communication interface in response to receiving a location-based accident information request from a user;

receiving, from the one or more backend servers over the wireless network connection, a list of accidents identified as being in proximity to the mobile device;

displaying, on the display screen, at least one accident indication for a corresponding at least one accident from the received list of accidents identified as being in proximity to the mobile device;

receiving, from the user, a selection of an accident of interest from the displayed at least one accident indication;

requesting, from the one or more backend servers and in response to the selection of the accident of interest, information corresponding to the accident of interest; and displaying, on the display screen, at least one of vehicle-specific and accident-specific information corresponding to the accident of interest.

11. The mobile device of claim 10, wherein the location information comprises a current GPS location of the mobile device.

12. The mobile device of claim 10, wherein the list of accidents comprises accidents identified as being within a predetermined area around a current location of the mobile device.

13. The mobile device of claim 10, wherein the list of accidents comprises accidents involving vehicles equipped with an automatic crash notification system that is in communication with the one or more backend servers.

14. The mobile device of claim 10, wherein the at least one accident indication comprises at least one accident icon on a graphical map displayed on the display screen.

15. The mobile device of claim 10, wherein the vehicle-specific information comprises at least one of vehicle type, vehicle engine type, fuel level, airbag configuration, location of batteries, high voltage wires, location of bodywork reinforcements, recommended cut locations for roof removal, location of door hinges and door locks and vehicle-special instructions.

16. The mobile device of claim 10, wherein the accident-specific information comprises at least one of a likelihood of severe injury, a crash type, area of impact, angle of impact, number of occupants, and seat position of occupants.

17. The mobile device of claim 10, wherein the one or more programs further include processor-executable instructions for:

receiving a non-location-based vehicle search request and one or more vehicle search parameters from the user, identifying a vehicle type based on said one or more vehicle search parameters, and displaying vehicle-specific rescue information on the display screen.

18. The mobile device of claim 17, wherein the one or more vehicle search parameters comprises one of a vehicle identification number and vehicle image data.

* * * * *